US006720542B2

(12) United States Patent
Jeung

(10) Patent No.: US 6,720,542 B2
(45) Date of Patent: Apr. 13, 2004

(54) MICROWAVE OVEN AND METHOD OF MANUFACTURING THE SAME

(75) Inventor: Tea-Hee Jeung, Suwon (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 10/253,503

(22) Filed: Sep. 25, 2002

(65) Prior Publication Data

US 2003/0209544 A1 Nov. 13, 2003

(30) Foreign Application Priority Data

May 13, 2002 (KR) ..... 2002-26239

(51) Int. Cl.[7] ..... H05B 6/64
(52) U.S. Cl. ..... 219/756
(58) Field of Search ..... 219/702, 715, 219/722, 723, 724, 756, 414; 439/928, 926

(56) References Cited

U.S. PATENT DOCUMENTS 5,521,359 A * 5/1996 Bone ..... 219/723
5,726,424 A * 3/1998 Koether ..... 219/414
5,986,246 A * 11/1999 Lee ..... 219/723

FOREIGN PATENT DOCUMENTS

JP 1159533 6/1989

* cited by examiner

*Primary Examiner*—Philip H. Leung
(74) *Attorney, Agent, or Firm*—Staas & Halsey LLP

(57) ABSTRACT

A microwave oven having two contact units and a method of manufacturing such a microwave oven. The contact units transceive electrical current and signals between a variety of electrical and electronic devices installed in a machine room of the microwave oven. The contact units include a first contact unit connected to a part of the devices, and a second contact unit connected to another part of the devices. First and second contact terminals are respectively provided at the first and second contact units to connect the two contact units to each other. During the assembly of the microwave oven, the contact units are separately connected to the associated devices prior to the installation of the devices in the machine room. After the installation of the devices in the machine room, the first and second contact terminals of the two contact units are electrically connected to each other to connect the two contact units. Accordingly, it is easy and convenient to install the contact units in the machine room.

19 Claims, 6 Drawing Sheets

MICROWAVE OVEN AND METHOD OF MANUFACTURING THE SAME

CROSS-REFERENCE TO RELATED APPLICATIONS

This application claims the benefit of Korean Patent Application No. 2002-26239 filed on May 13, 2002, in the Korean Industrial Property Office, the disclosure of which is incorporated herein by reference.

BACKGROUND OF THE INVENTION

1. Field of the Invention

The present invention relates to microwave ovens, and more particularly, to a microwave oven having a partitionable contact unit.

2. Description of the Related Art

Generally, a microwave oven is an electrically operated oven having a magnetron which generates high-frequency electromagnetic waves. The high-frequency electromagnetic waves have a fundamental frequency of 2450 MHz and are radiated into a cooking cavity of the microwave oven to cook food.

FIG. 1 shows a conventional microwave oven having a body 1 partitioned into a cooking cavity (not shown) and a machine room 2. The cooking cavity seats food therein during a cooking operation, and the machine room 2 receives a variety of electrical and electronic devices therein. A door (not shown) is hinged to the body 1 at a position in front of the cooking cavity so as to close the cooking cavity. A control panel 3 is installed on a front wall of the body 1 at a position in front of the machine room 2, and allows a user to select desired operational modes and conditions of the microwave oven.

A variety of electrical and electronic devices, which drive and control the microwave oven, are installed in the machine room 2. The electrical and electronic devices installed in the machine room 2 include a printed circuit board (PCB) 4, a magnetron 5, a high-tension transformer 6, a cooling fan 7, a body latch 8, three safety switches 9A, 9B and 9C, a noise filter 10, and a temperature sensor 11. The PCB 4 is installed in the back of the control panel 3, and outputs control signals to the devices inside the machine room 2 in response to input signals output from the control panel 3, so as to drive the devices. The magnetron 5 generates high-frequency electromagnetic waves, which are radiated into the cooking cavity. The high-tension transformer 6 applies a high voltage to the magnetron 5. The cooling fan 7 sucks atmospheric air into the machine room 2 so as to cool the devices, such as the high-tension transformer 6 and the magnetron 5, installed within the machine room 2. The body latch 8 selectively engages with the door to maintain the door at a closed position, or releases the door to open it. The three safety switches 9A, 9B and 9C are installed on the body latch 8, and prevent a leakage of the high-frequency electromagnetic waves through the opening of the cooking cavity where the door is opened. The noise filter 10 is connected to an electrical cord extending from an external power supply, thus filtering an input electrical current to remove high-frequency noise from the current. The temperature sensor 11 senses a temperature inside the cooking cavity.

To operate such a conventional microwave oven in a selected mode, it is necessary to transmit both a filtered electrical current, which has been processed by the noise filter 10, and signals output from, for example, the PCB 4 to the devices installed in the machine room 2. Therefore, a contact unit 12 is provided in the machine room 2. The contact unit 12 is connected to the electrical and electronic devices to transceive the electrical current and signals between the devices.

The contact unit 12 includes strands of electrical wires with a terminal provided at each end of each wire and connected to an associated device, so as to transceive the electrical current and signals from or to the device.

In such a conventional microwave oven, the contact unit 12 is produced in a form of a single structure, and is necessarily connected to the devices installed in the machine room 2 so as to transceive the electrical current and the signals between the devices. Therefore, the installation of the contact unit 12 in the machine room 2 is only allowed after the installation of all of the devices in the machine room 2. Therefore, the conventional microwave oven having such a contact unit 12 is problematic in that the order of installing the devices and the contact unit 12 in the machine room 2 is undesirably limited. In addition, since only a limited space remains in the machine room when installing the contact unit 12 in the room 2 after the installation of all of the devices in the machine room 2, it is very difficult to install the contact unit 12.

SUMMARY OF THE INVENTION

Accordingly, it is an object of the present invention to provide a microwave oven, which is designed to allow an easy installation of a contact unit in a machine room of the microwave oven. Another object of the present invention is to provide a method of manufacturing such a microwave oven.

Additional objects and advantages of the invention will be set forth in part in the description which follows and, in part, will be obvious from the description, or may be learned by practice of the invention.

To achieve the above and other objects of the present invention, there is provided a microwave oven comprising a machine room which includes a plurality of devices installed in the machine room, a first contact unit connected at a first end thereof to a part of the devices, and a second contact unit connected at a first end thereof to another part of the devices and connected at a second end thereof to a second end of the first contact unit.

The first contact unit comprises first electrical wires having a first transceiving terminal provided at a first end of each of the first electrical wires and connected to the part of the devices, and a first contact terminal which binds second ends of the first electrical wires into a single body and connected to the second contact unit. The second contact unit comprises second electrical wires having a second transceiving terminal provided at a first end of each of the second electrical wires and connected to the another part of the devices, and a second contact terminal which binds second ends of the second electrical wires into a single body and connected to the first contact terminal.

The first and second contact terminals are separated and connected to each other through a fitting-type engagement.

One of the first and second contact terminals has projecting terminals, and the remaining contact terminal has holed terminals which receive the corresponding projecting terminals therein. The first and second contact terminals are electrically connected to each other in response to the holding terminals receiving the corresponding projecting terminals.

The part of the devices connected to the first contact unit includes at least one of a noise filter which removes high-frequency components from electricity supplied to the microwave oven, a cooling fan which cools the machine room, a temperature sensor which senses a temperature in a cooking cavity of the microwave oven, and a lamp which illuminates an interior of the cooking cavity. The first transceiving terminals include at least one of a fan terminal connected to the cooling fan, a filter terminal connected to the noise filter, a sensor terminal connected to the temperature sensor, and a lamp terminal connected to the lamp.

The another part of the devices connected to the second contact unit includes at least one of a printed circuit board which outputs control signals to perform a cooking operation, a body latch which selectively engages with a door hinged to a front of a cooking cavity of the microwave oven so as to close/open the door, at least one safety switch which is installed on the body latch and prevents a leakage of high-frequency electromagnetic waves from the cooking cavity in response to the door being opened, a high-tension transformer which applies a high voltage to a magnetron of the microwave oven that irradiates the high-frequency electromagnetic waves, and a drive motor which rotates a cooking tray installed in the cooking cavity. The second transceiving terminals include at least one of a PCB terminal connected to the printed circuit board, at least one switch terminal connected to the safety switch, a transformer terminal connected to the high-tension transformer, and a motor terminal connected to the drive motor.

The first contact unit is connected to the noise filter and the cooling fan through the filter terminal and the fan terminal of the first transceiving terminals, respectively, so as to form a cooling fan assembly.

The second contact unit is connected to the safety switch installed on the body latch through the switch terminal of the second transceiving terminals, so as to form a body latch assembly.

According to an aspect of the present invention, there is provided a microwave oven comprising a machine room which includes a plurality of devices installed in the machine room, a cooling fan assembly which comprises a cooling fan which cools the machine room, a noise filter which is mounted at the cooling fan and removes high-frequency noise from electricity supplied to the microwave oven, and a first contact unit including first electrical wires having a first transceiving terminal provided at a first end of each of the first electrical wires and connected to a part of the devices including the cooling fan and the noise filter, and a first contact terminal which binds second ends of the first electrical wires into a single body. The machine room further includes a body latch assembly which comprises a body latch which selectively engages with a door hinged to a front of a cooking cavity of the microwave oven so as to close/open the door, at least one safety switch which is installed to the body latch and prevents a leakage of high-frequency electromagnetic waves from the cooking cavity in response to the door being opened, and a second contact unit including second electrical wires having a second transceiving terminal provided at a first end of each of the second electrical wires and connected to another part of the devices including the safety switch, and a second contact terminal which binds second ends of the second electrical wires into a single body and connected to the first contact terminal.

To achieve the above and other objects of the present invention, there is also provided a method of manufacturing a microwave oven having a machine room which includes a plurality of devices, the method comprising producing a first contact unit being provided at a first end thereof with a first transceiving terminal for transceiving electricity and signals to or from a part of the devices installed in the machine room, and at a second end thereof with a first contact terminal, producing a second contact unit being provided at a first end thereof with a second transceiving terminal for transceiving electricity and signals to or from another part of the devices, and at a second end thereof with a second contact terminal for being electrically connected to the first contact terminal, connecting the first contact unit to any one of the part of the devices to form a first assembly, connecting the second contact unit to any one of the another part of the devices to form a second assembly, installing the first assembly in the machine room, installing the second assembly in the machine room, and connecting the first contact terminal and the second contact terminal to each other.

In the method, the part of the devices associated with the first contact unit is at least one of a noise filter, a cooling fan, a temperature sensor and a lamp, and the another part of the devices associated with the second contact unit is at least one of a printed circuit board, a body latch, a safety switch and a high-tension transformer.

In the above method, the first assembly is a cooling fan assembly produced by connecting the first contact unit to the cooling fan and the noise filter installed at the cooling fan, and the second assembly is a body latch assembly produced by connecting the second contact unit to the safety switch installed at the body latch.

BRIEF DESCRIPTION OF THE DRAWINGS

These and other objects and advantages of the present invention will become apparent and more readily appreciated from the following description of the embodiments, taken in conjunction with the accompanying drawings of which.

DETAILED DESCRIPTION OF THE PREFERRED EMBODIMENTS

Figure 1:
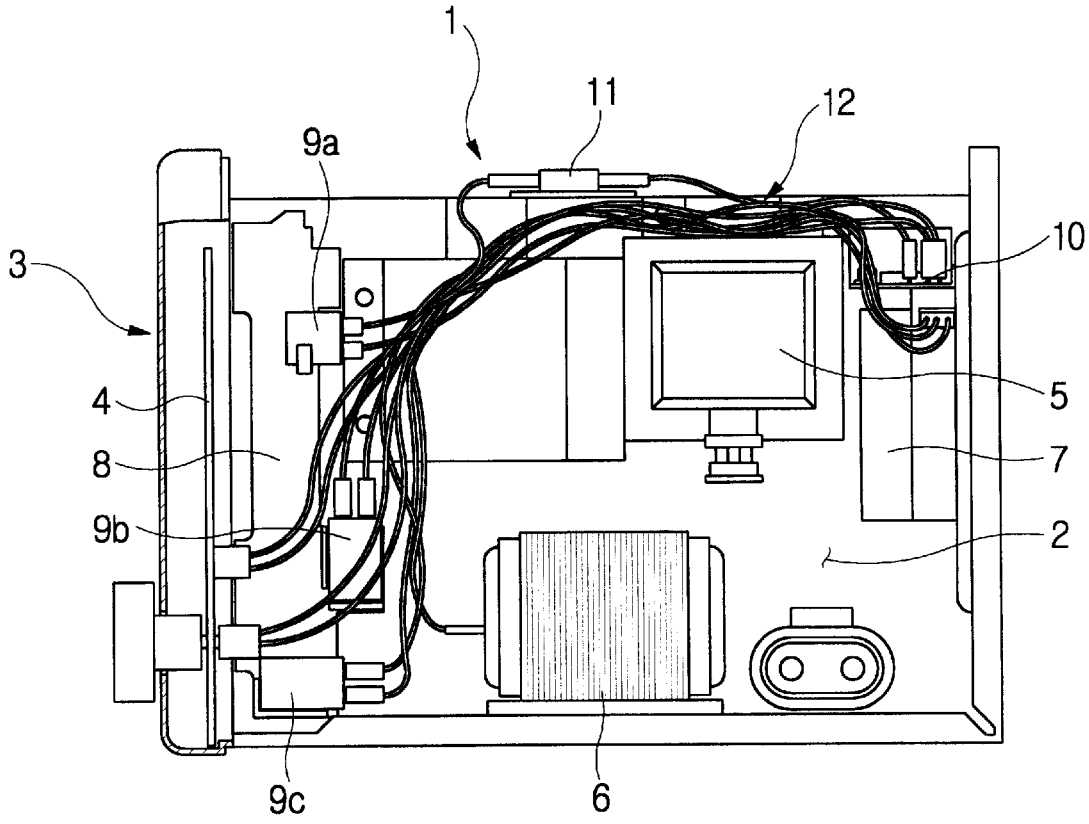
FIG. 1 (PRIOR ART)
FIG. 1 is a side sectional view of electrical and electronic devices installed in a machine room of a conventional microwave oven.

Reference will now be made in detail to the embodiments of the present invention, examples of which are illustrated in the accompanying drawings, wherein like reference numerals refer to the like elements throughout. The embodiments are described below in order to explain the present invention by referring to the figures.

Figure 2:
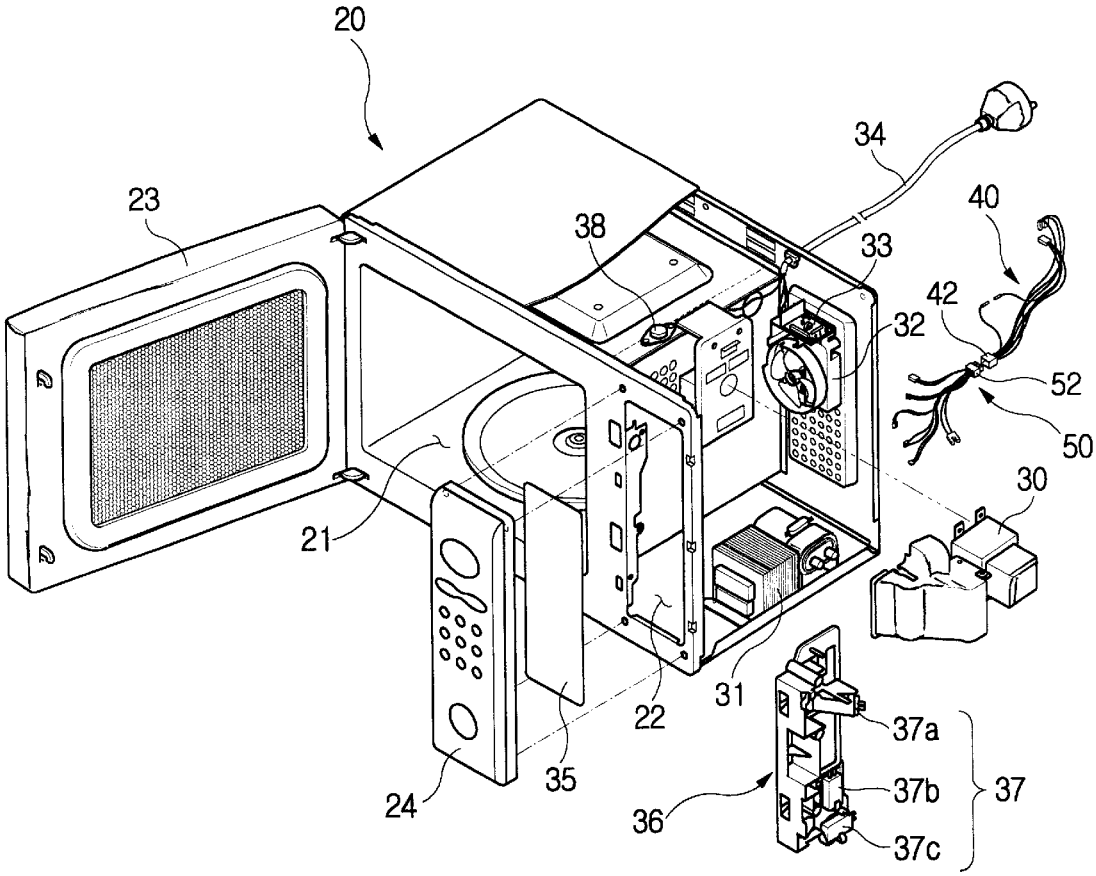
FIG. 2 is an exploded perspective view of a microwave oven having separated contact units in accordance with an embodiment of the present invention.
Figure 3:
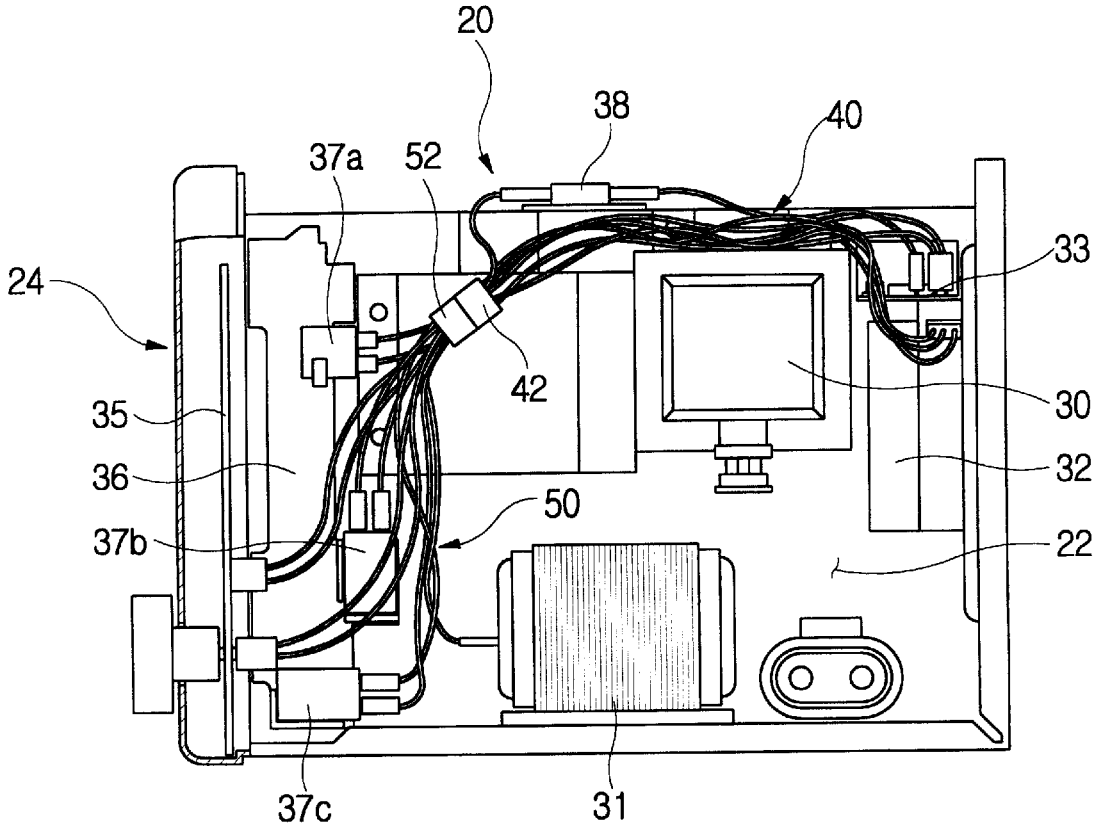
FIG. 3 is a side view illustrating the construction of devices and the contact units installed in a machine room of the microwave oven shown in FIG. 2.

FIGS. 2 and 3 show a microwave oven according to an embodiment of the present invention. The microwave oven comprises a body 20 which forms the outer appearance of the microwave oven, and the interior of which is partitioned into a cooking cavity 21 and a machine room 22. The cooking cavity 21 is opened at its front and seats food therein while cooking the food. The machine room 22 receives a variety of electrical and electronic devices therein. A door 23 is hinged to the body 20 at a position in front of the cooking cavity 21 so as to close the cooking cavity 21. A control panel 24 is installed on a front wall of the body 20 at a position in front of the machine room 22, and allows a user to select desired operational modes and conditions of the microwave oven.

The electrical and electronic devices installed in the machine room 22 include a magnetron 30 and a high-tension transformer 31. The magnetron 30 generates high-frequency electromagnetic waves, which are radiated into the cooking cavity 21. The high-tension transformer 31 applies a high voltage to the magnetron 30. Where the high-tension transformer 31 applies the high voltage to the magnetron 30, the magnetron 30 generates the high-frequency electromagnetic waves, and radiates them into the cooking cavity 21, thus cooking the food in the cooking cavity 21.

In addition to the magnetron 30 and the high-tension transformer 31, a variety of other electrical and electronic devices are installed in the machine room 22, such as a cooling fan 32, a noise filter 33, an electrical cord wire 34, a printed circuit board (PCB) 35, a body latch 36, three safety switches 37, and a temperature sensor 38.

The cooling fan 32 is installed in a rear section of the machine room 22, and sucks atmospheric air into the machine room 22 so as to cool the devices, such as the high-tension transformer 31 and the magnetron 30. The noise filter 33 is installed at a top of the cooling fan 32, and filters the input electric current to remove high-frequency noise from the input electric current. The electrical cord 34 extends from an external power supply to the noise filter 33, and supplies an electric current from the power supply to the microwave oven. The PCB 35 is installed in back of the control panel 24, and outputs control signals to the devices inside the machine room 22 in response to input signals output from the control panel 24, so as to controllably drive the microwave oven. The body latch 36 selectively engages with the door 23 to maintain the door 23 at a closed position, or releases the door 23 to open it. The three safety switches 37 are installed on the body latch 36, and prevent a leakage of high-frequency electromagnetic waves through the opening of the cooking cavity 21 where the door 23 is opened. The temperature sensor 38 is installed on an upper surface of a top wall of the cooking cavity 21, and senses the temperature inside the cooking cavity 21. The three safety switches 37 comprise a primary switch 37A, a monitor switch 37B and a door switch 37C which are sequentially arranged on the door latch 36 from the top to the bottom.

In addition, a power relay (not shown), a drive motor (not shown) and a lamp (not shown) are installed in the machine room 22. The power relay applies electric power to both the high-tension transformer 31 and the monitor switch 37B. The drive motor generates a rotational force to rotate a cooking tray installed in the cooking cavity 21. The lamp illuminates the interior of the cooking cavity 21.

In the microwave oven of the present invention, contact units 40 and 50 are provided in the machine room 22 such that the contact units 40 and 50 are connected to the devices inside the machine room 22 to transceive the electrical current and control signals between the devices.

The contact units comprise a first contact unit 40 and a second contact unit 50. The first contact unit 40 transceives the electrical current and control signals to or from the devices installed in a rear section of the machine room 22. The second contact unit 50 transceives the electrical current and control signals to or from the devices installed in a front section of the machine room 22. The two contact units 40 and 50 are electrically connected to each other.

Figure 4:
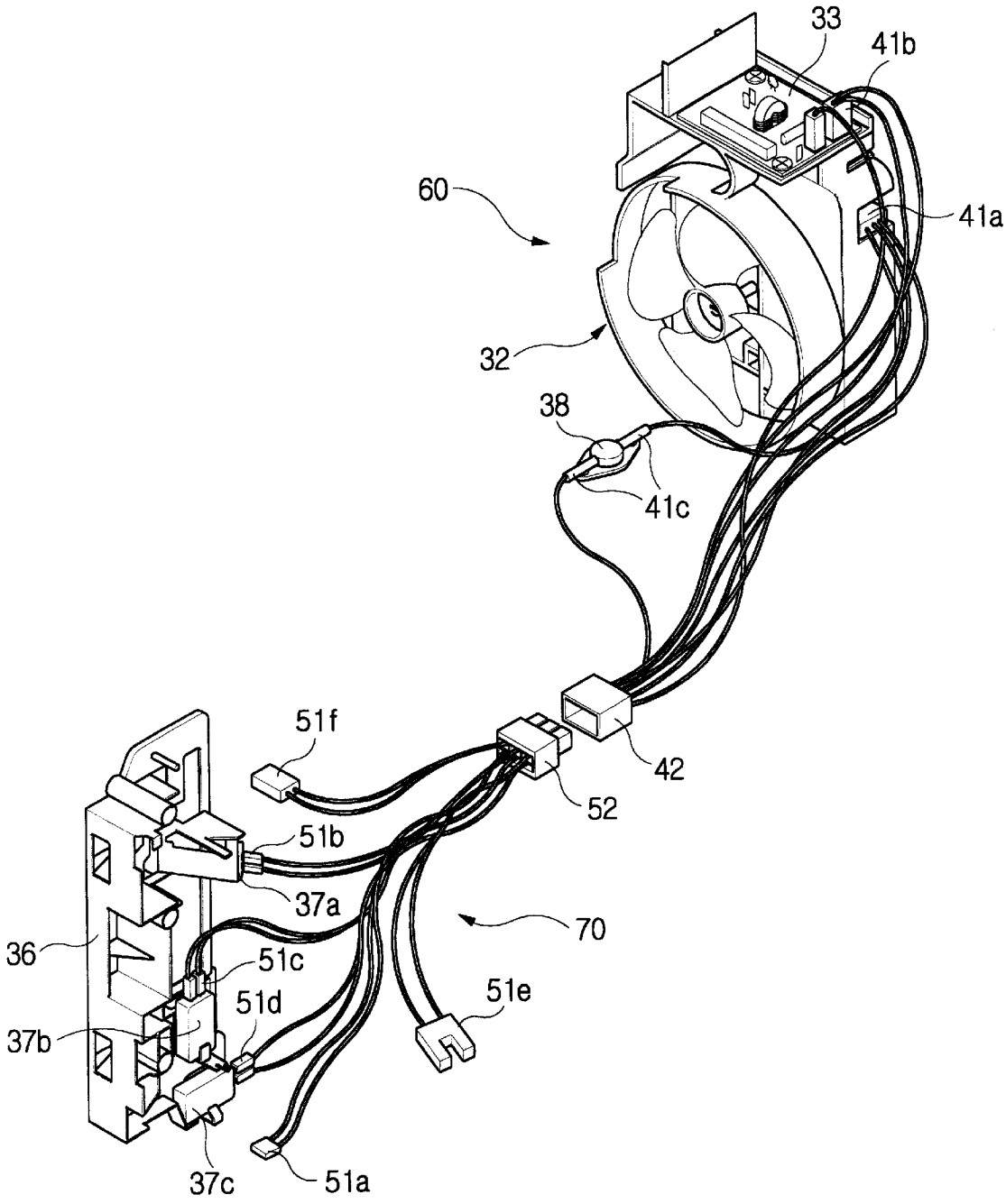
FIG. 4 is a perspective view of a cooling fan assembly and a body latch assembly of the microwave oven shown in FIG. 2.

FIG. 4 shows that each of the contact units 40 and 50 comprises several strands of electrical wires, with one contact terminal 42 or 52, and a plurality of transceiving terminals 41 or 51. The contact terminal 42 or 52 of each of the contact units 40 and 50 is provided at first ends of the electrical wires of the contact unit 40 or 50 such that the first ends of the electrical wires are bound into a single body by the contact terminal 42 or 52. The contact terminals 42 and 52 of the two contact units 40 and 50 are designed so as to be connected to each other through a fitting-type engagement. The transceiving terminals 41 or 51 of each of the first and second contact units 40 and 50 include several terminals 41A, 41B and 41C, or 51A, 51B, 51C, 51D, 51E and 51F, which are respectively provided at the second ends of the electrical wires of the contact unit 40 or 50, and connected to associated devices so as to transceive the electrical current and control signals to or from the devices.

For ease of description, the transceiving terminals of the first contact unit 40 are referred to as first transceiving terminals 41. The first transceiving terminals 41 of the first contact unit 40 include a fan terminal 41A, a filter terminal 41B and a sensor terminal 41C, which are respectively connected to the cooling fan 32, the noise filter 33 and the temperature sensor 38 so as to transceive the electrical current and control signals to or from them. The first contact unit 40 also has the first contact terminal 42 which electrically connects the first contact unit 40 to the second contact unit 50.

In the same manner, the transceiving terminals of the second contact unit 50 are referred to as second transceiving terminals 51. The second transceiving terminals 51 of the second contact unit 50 include a PCB terminal 51A, three switch terminals 51B, 51C and 51D, a transformer terminal 51E and a lamp terminal (not shown), which are respectively connected to the PCB 35, the three safety switches 37A, 37B and 37C, the high-tension transformer 31 and the lamp (not shown) so as to transceive the electrical current and control signals to or from them. The second contact unit 50 also has the second contact terminal 52 which electrically connects the second contact unit 50 to the first contact unit 40.

In the drawing, the reference numeral 51F denotes a relay terminal which is connected to the power relay (not shown).

Figure 5:
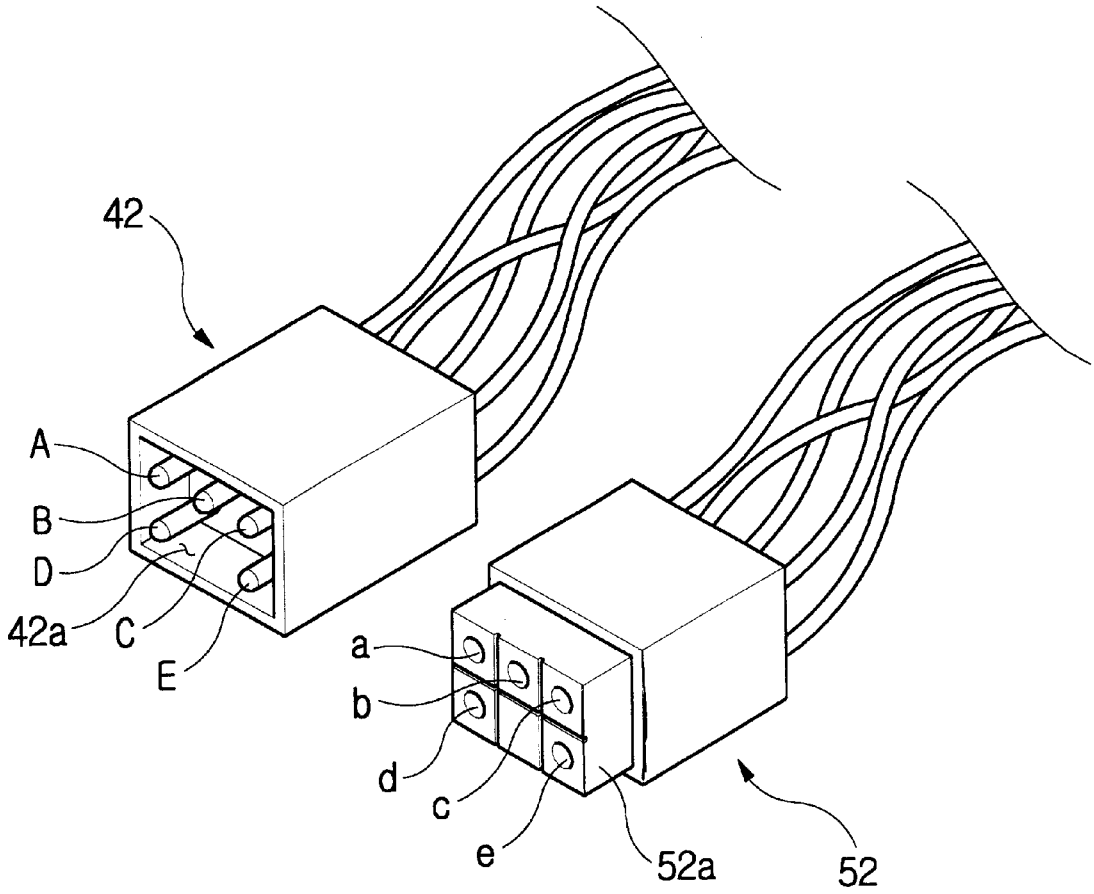
FIG. 5 is a perspective view of first and second contact terminals included in the contact units of the microwave oven shown in FIG. 2.

FIG. 5 shows that the two contact terminals 42 and 52 of the contact units 40 and 50 are designed so as to be connected to each other through a fitting-type engagement. That is, the first contact terminal 42 has a fitting recess 42A, while the second contact terminal 52 has a fitting protrusion 52A. Therefore, to connect the two contact units 40 and 50 to each other, the fitting protrusion 52A of the second contact terminal 52 is fitted into the fitting recess 42A of the first contact terminal 42.

Each of the two contact terminals 42 and 52 has a plurality of connecting terminals. That is, the first contact terminal 42 includes five rod-shaped terminals A, B, C, D and E in the fitting recess 42A. The second contact terminal 52 includes five hole-shaped terminals a, b, c, d and e in the fitting protrusion 52A. To electrically connect the two contact terminals 42 and 52 to each other, the five rod-shaped terminals A, B, C, D and E of the first contact terminal 42 are respectively fitted into the five hole-shaped terminals a, b, c, d and e of the second contact terminal 52.

That is, the first rod-shaped terminal A is inserted into the first hole-shaped terminal "a," the second rod-shaped terminal B is inserted into the second hole-shaped terminal "b," the third rod-shaped terminal C is inserted into the third hole-shaped terminal "c," the fourth rod-shaped terminal D is inserted into the fourth hole-shaped terminal "d," and the fifth rod-shaped terminal E is inserted into the fifth hole-shaped terminal "e."

Accordingly, the engagement of the first rod-shaped terminal A with the first hole-shaped terminal "a" transmits a signal from the temperature sensor 38, which is connected to the first contact unit 40, to the PCB 35 which is connected to the second contact unit 50. In the same manner, the engagement of the second rod-shaped terminal B with the second hole-shaped terminal "b" transmits a signal from the primary switch 37A, which is connected to the second contact unit 50, to the cooling fan 32 which is connected to the first contact unit 40. The engagement of the third rod-shaped terminal C with the third hole-shaped terminal "c" transmits the electrical current from the cooling fan 32, which is connected to the first contact unit 40, to the drive motor (not shown) which is connected to the second contact unit 50. The engagement of the fourth rod-shaped terminal D with the fourth hole-shaped terminal "d" transmits a signal from the lamp (not shown), which is connected to the first contact unit 40, to the PCB 35 which is connected to the second contact unit 50. In the same manner, the engagement of the fifth rod-shaped terminal E with the fifth hole-shaped terminal "e" transmits the electrical current from the noise filter 33, which is connected to the first contact unit 40, to the power relay (not shown) which is connected to the second contact unit 50.

In such a case, the electrical current is transmitted from the noise filter 33 to both the cooling fan 32 and the temperature sensor 38 through the fan terminal 41A and the sensor terminal 41C of the first contact unit 40. The electrical current is, thereafter, transmitted to the second contact unit 50 through the engagement of the fifth rod-shaped terminal E with the fifth hole-shaped terminal "e," and distributed to the transformer 31 and the monitor switch 37B by the power relay (not shown) connected to the relay terminal 51F of the second contact unit 50.

As described above, the first and second contact units 40 and 50 are connectively separated from each other so as to be separately connected to the associated devices of the machine room 22. Accordingly, it is possible to separately connect the two contact units 40 and 50 to their respective devices before the devices are installed in the machine room 22.

Therefore, the installation of the contact units 40 and 50 in the machine room 22 is easily and conveniently accomplished. That is, before the installation of the devices in the machine room 22, the transceiving terminals 41 of the first contact unit 40 are connected to the associated devices to fabricate a first assembly, and the transceiving terminals 51 of the second contact unit 50 are connected to the associated devices to fabricate a second assembly. Thereafter, the two groups of devices, which are separately connected to the two contact units 40 and 50, are separately installed in the machine room 22, and so the two contact units 40 and 50 are easily and conveniently installed in the machine room 22.

Referring to FIG. 4, the first and second assemblies are a cooling fan assembly 60 and a body latch assembly 70, respectively. The cooling fan assembly 60 comprises the first contact unit 40, with the cooling fan 32 and the noise filter 33 respectively connected to the fan terminal 41A and the filter terminal 41B of the first contact unit 40. The body latch assembly 70 comprises the second contact unit 50, the three safety switches 37 connected to the three switch terminals 51A, 51B and 51C of the second contact unit 50, and the body latch 36 holding the three safety switches 37.

When assembling the microwave oven of the present invention, the cooling fan assembly 60 with the first contact unit 40, and the body latch assembly 70 with the second contact unit 50 are separately installed in the machine room 22. Thereafter, the first and second contact units 40 and 50 are connected to each other, so as to transceive the electrical current and control signals between the devices installed in the machine room 22, through the two contact units 40 and 50.

Figure 6:
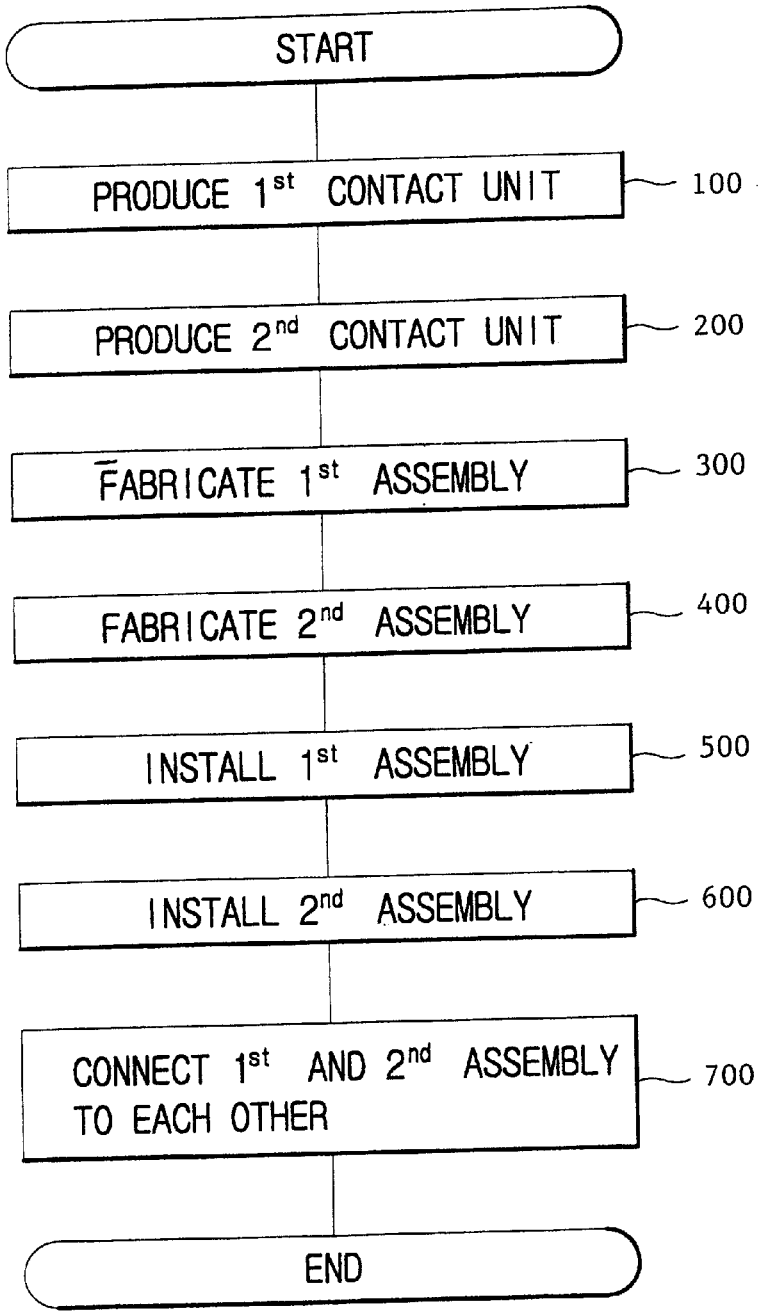
FIG. 6 is a flowchart of a method of manufacturing the microwave oven shown in FIG. 2.

FIG. 6 shows a method of manufacturing the microwave oven of the present invention. The method and an operational effect of the microwave oven will be described in detail herein below with reference to FIGS. 2–5.

In operation 100, the first contact unit 40 having both the first transceiving terminals 41 and the first contact terminal 42 is produced. In operation 200, the second contact unit 50 having both the second transceiving terminals 51 and the second contact terminal 52 is produced. Thereafter, in operation 300, the first contact unit 40 is connected to an associated device, for example, the cooling fan 38, to form a first assembly, for example, the cooling fan assembly 60. In operation 400, the second contact unit 50 is connected to an associated device, for example, the safety switches 37, to form a second assembly, for example, the body latch assembly 70. Thereafter, in operation 500, the first assembly is installed in the machine room 22. In operation 600, the second assembly is installed in the machine room 22. After the installation of the two assemblies in the machine room 22, the contact terminals 42 and 52 of the first and second contact units 40 and 50 are connected to each other in operation 700, thus electrically connecting the two contact units 40 and 50 to each other.

Therefore, it is easy and convenient to install the contact units 40 and 50 in the machine room 22, since the contact units 40 and 50 are separately connected to the associated devices prior to the installation of the devices in the machine room 22.

As described above, the present invention provides a microwave oven with two contact units, and a method of manufacturing such a microwave oven. In the microwave oven of the present invention, a contact unit is divided into first and second contact units, so as to separately connect the contact units to associated devices prior to the installation of the devices in a machine room of the microwave oven. After the installation of the devices in the machine room, contact terminals of the two contact units are connected to each other to electrically connect the devices to each other through the two contact units. Accordingly, it is easy and convenient to install the contact units in the machine room.

Although a few embodiments of the present invention have been shown and described, it will be appreciated by those skilled in the art that changes may be made in these embodiments without departing from the principles and spirit of the invention, the scope of which is defined in the appended claims and their equivalents.

What is claimed is:

1. A microwave oven comprising a machine room which includes:

a plurality of devices installed in the machine room:

a first contact unit connected at a first end thereof to a part of the devices; and a second contact unit connected at a first end thereof to another part of the devices, and connected at a second end thereof to a second end of the first contact unit, wherein:

the first contact unit comprises first electrical wires having:

a first transceiving terminal provided at a first end of each of the first electrical wires, and connected to the part of the devices; and a first contact terminal which binds second ends of the first electrical wires into a single body, and connected to the second contact unit, and the second contact unit comprises second electrical wires having:

a second transceiving terminal provided at a first end of each of the second electrical wires, and connected to the another part of the devices; and a second contact terminal which binds second ends of the second electrical wires into a single body, and connected to the first contact terminal.

2. The microwave oven according to claim 1, wherein the first and second contact terminals are separated and connected to each other through a fitting-type engagement.

3. The microwave oven according to claim 2, wherein:

one of the first and second contact terminals has projecting terminals, the remaining contact terminal has holed terminals which receive the corresponding projecting terminals therein, and the first and second contact terminals are electrically connected to each other in response to the holding terminals receiving the corresponding projecting terminals.

4. The microwave oven according to claim 2, wherein:

the part of the devices connected to the first contact unit includes at least one of:

a noise filter which removes high-frequency components from electricity supplied to the microwave oven;

a cooling fan which cools the machine room;

a temperature sensor which senses a temperature in a cooking cavity of the microwave oven; and a lamp which illuminates an interior of the cooking cavity, and the first transceiving terminals include at least one of:

a fan terminal connected to the cooling fan;

a filter terminal connected to the noise filter, a sensor terminal connected to the temperature sensor; and a lamp terminal connected to the lamp.

5. The microwave oven according to claim 4, wherein the first contact unit is connected to the noise filter and the cooling fan through the filter terminal and the fan terminal of the first transceiving terminals, respectively, so as to form a cooling fan assembly.

6. The microwave oven according to claim 2, wherein:

the another part of the devices connected to the second contact unit includes at least one of:

a printed circuit board which outputs control signals to perform a cooking operation;

a body latch which selectively engages with a door hinged to a front of a cooking cavity of the microwave oven so as to close/open the door;

at least one safety switch which is installed on the body latch, and prevents a leakage of high-frequency electromagnetic waves from the cooking cavity in response to the door being opened;

a high-tension transformer which applies a high voltage to a magnetron of the microwave oven that radiates the high-frequency electromagnetic waves; and a drive motor which rotates a cooking tray installed in the cooking cavity, and the second transceiving terminals include at least one of:

a PCB terminal connected to the printed circuit board;

at least one switch terminal connected to the safety switch;

a transformer terminal connected to the high-tension transformer; and a motor terminal connected to the drive motor.

7. The microwave oven according to claim 6, wherein the second contact unit is connected to the safety switch installed on the body latch through the switch terminal of the second transceiving terminals, so as to form a body latch assembly.

8. The microwave oven according to claim 1, wherein:

the part of the devices connected to the first contact unit includes at least one of:

a noise filter which removes high-frequency components from electricity supplied to the microwave oven;

a cooling fan which cools the machine room;

a temperature sensor which senses a temperature in a cooking cavity of the microwave oven; and a lamp which illuminates an interior of the cooking cavity, and the first transceiving terminals include at least one of:

a fan terminal connected to the cooling fan;

a filter terminal connected to the noise filter;

a sensor terminal connected to the temperature sensor; and a lamp terminal connected to the lamp.

9. The microwave oven according to claim 8, wherein the first contact unit is connected to the noise filter and the cooling fan through the filter terminal and the fan terminal of the first transceiving terminals, respectively, so as to form a cooling fan assembly.

10. The microwave oven according to claim 1 wherein:

the another part of the devices connected to the second contact unit includes at least one of:

a printed circuit board which outputs control signals to perform a cooking operation;

a body latch which selectively engages with a door hinged to a front of a cooking cavity of the microwave oven so as to close/open the door;

at least one safety switch which is installed on the body latch and prevents a leakage of high-frequency electromagnetic waves from the cooking cavity in response to the door being opened;

a high-tension transformer which applies a high voltage to a magnetron of the microwave oven that radiates the high-frequency electromagnetic waves; and a drive motor which rotates a cooking tray installed in the cooking cavity, and the second transceiving terminals include at least one of:

a PCB terminal connected to the printed circuit board;

at least one switch terminal connected to the safety switch;

a transformer terminal connected to the high-tension transformer; and a motor terminal connected to the drive motor.

11. The microwave oven according to claim 10, wherein the second contact unit is connected to the safety switch installed on the body latch through the switch terminal of the second transceiving terminals, so as to form a body latch assembly.

12. A microwave oven, comprising a machine room which includes:

a plurality of devices installed in the machine room;

a cooling fan assembly which comprises:

a cooling fan which cools the machine room, a noise filter which is mounted to the cooling fan and removes high-frequency noise from electricity supplied to the microwave oven, and a first contact unit including first electrical wires having:

a first transceiving terminal provided at a first end of each of the first electrical wires, and connected to a part of the devices including the cooling fan and the noise filter; and a first contact terminal which binds second ends of the first electrical wires into a single body; and a body latch assembly which comprises:

a body latch which selectively engages with a door hinged to a front of a cooking cavity of the microwave oven so as to close/open the door, at least one safety switch which is installed to body latch and prevents a leakage of high-frequency electromagnetic waves from the cooking cavity in response to the door being opened, and a second contact unit including second electrical wires having:

a second transceiving terminal provided at a first end of each of the second electrical wires, and connected to another part of the devices including the safety switch; and a second contact terminal which binds second ends of the second electrical wires into a single body, and connected to the first contact terminal.

13. The microwave oven according to claim 12, wherein the first and second contact terminals are separated and connected to each other through a fitting-type engagement.

14. The microwave oven according to claim 13, wherein:

one of the first and second contact terminals has projecting terminals, the remaining contact terminal has holed terminals which receive the corresponding projecting terminals therein, and the first and second contact terminals are electrically connected to each other in response to the holding terminals receiving the corresponding projecting terminals.

15. A method of manufacturing a microwave oven having a machine room which includes a plurality of devices, the method comprising:

producing a first contact unit being provided at a first end thereof with a first transceiving terminal for transceiving electricity and signals to or from a part of the devices installed in the machine room, and at a second end thereof with a first contact terminal;

producing a second contact unit being provided at a first end thereof with a second transceiving terminal for transceiving electricity and signals to or from another part of the devices, and at a second end thereof with a second contact terminal for being electrically connected to the first contact terminal;

connecting the first contact unit to any one of the part of the devices to form a first assembly;

connecting the second contact unit to any one of the another part of the devices to form a second assembly;

installing the first assembly in the machine room;

installing the second assembly in the machine room; and connecting the first contact terminal and the second contact terminal to each other.

16. The method according to claim 15, wherein:

the part of the devices associated with the first contact unit is at least one of a noise filter, a cooling fan, a temperature sensor and a lamp, and the another part of the devices associated with the second contact unit is at least one of a printed circuit board, a body latch, a safety switch and a high-tension transformer.

17. The method according to claim 16, wherein:

the first assembly is a cooling fan assembly produced by connecting the first contact unit to the cooling fan and the noise filter installed at the cooling fan, and the second assembly is a body latch assembly produced by connecting the second contact unit to the safety switch installed at the body latch.

18. A microwave oven comprising a machine room which includes:

a plurality of devices installed in the machine room;

a first contact unit connected at a first end thereof to a part of the devices; and a second contact unit connected at a first end thereof to another part of the devices, and connected at a second end thereof to a second end of the first contact unit, wherein the devices include:

a cooling fan which cools the machine room;

a magnetron which generates high-frequency electromagnetic waves to cook food;

a high-tension transformer which applies a high voltage to the magnetron;

a noise filter which removes high-frequency components from electricity supplied to the microwave oven;

a printed circuit board which outputs control signals to perform a cooking operation of the microwave oven;

a body latch which selectively engages with a door hinged to a front of a cooking cavity of the microwave oven so as to close/open the door;

at least one safety switch which is installed on the body latch, and prevents a leakage of the high-frequency electromagnetic waves from the cooking cavity in response to the door being opened;

a drive motor which rotates a cooking tray installed in the cooking cavity;

a temperature sensor which senses a temperature in the cooking cavity; and a lamp which illuminates an interior of the cooking cavity.

19. A microwave oven comprising a machine room which includes:

a plurality of devices installed in the machine room;

a first contact unit connected at a first end thereof to a part of the devices; and a second contact unit connected at a first end thereof to another part of the devices, and connected at a second end thereof to a second end of the first contact unit, wherein the second end of the second contact unit and the second end of the first contact unit are separated and connected to each other through a fitting-type engagement.

* * * * *